United States Patent [19]

Denissenko et al.

[11] 4,336,024

[45] Jun. 22, 1982

[54] PROCESS FOR CLEANING CLOTHES AT HOME

[75] Inventors: Serge Denissenko; Jean-Claude Rossard, both of Migné-Auxances, France

[73] Assignee: Airwick Industries, Inc., Carlstadt, N.J.

[21] Appl. No.: 234,220

[22] Filed: Feb. 13, 1981

[30] Foreign Application Priority Data

Feb. 22, 1980 [LU] Luxembourg ..... 82193

[51] Int. Cl.[3] ..... D06L 1/02

[52] U.S. Cl. ..... 8/142; 8/150

[58] Field of Search ..... 18/142, 150

[56] References Cited

U.S. PATENT DOCUMENTS

| | | | |
|---|---|---|---|
| 2,316,386 | 4/1943 | Albrecht | 8/142 |
| 3,686,125 | 8/1972 | Miller | 8/142 |
| 3,737,386 | 6/1973 | Geiss et al. | 252/162 |
| 3,827,857 | 8/1974 | Boulus | 8/142 |

FOREIGN PATENT DOCUMENTS

| | | |
|---|---|---|
| 2628480 | 1/1978 | Fed. Rep. of Germany . |
| 2126943 | 10/1972 | France . |
| 1471886 | 4/1977 | United Kingdom . |

*Primary Examiner*—Maria Parrish Tungol

*Attorney, Agent, or Firm*—Harry Falber

[57] ABSTRACT

Process for cleaning clothes at home with the aid of solvent, by

A. treating the article of clothing with a cleaning agent comprising at least one organic solvent, and then B. laying the article of clothing flat on an absorbent sheet, and C. laying the article of clothing+absorbent sheet flat on the interior circular surface of the drum of a washing machine in order to spin it.

Operation A can be carried out in two successive stages using a stain-removing agent and a rinsing agent.

10 Claims, No Drawings

PROCESS FOR CLEANING CLOTHES AT HOME

The present invention relates to a process for cleaning clothes at home.

It is well known that clothes can be cleaned by using the dry-cleaning process employing organic solvents, such as trichloroethylene, which possess a high solvent power towards the majority of substances which usually soil clothes, and a low boiling point which enables these solvents to be recovered easily.

One of the disadvantages of this process originates from the fact that, since the vapours of these solvents are toxic, the dry-cleaning can only be carried out in specialised establishments provided with large and very expensive equipment and with good ventilation. As a result, the user must leave the house in order to go to this establishment; moreover, the clothes cannot be cleaned within a period of time which enables the user to pick them up and take them away with him. The user therefore wastes a great deal of time and also has to go from one place to another, which generally costs him money. Moreover, by entrusting clothes to a specialist who is going to treat them in the same batch of solvent as numerous other articles of clothing, there is always a risk of infestation by microbes, such as bacteria, fungi and viruses, brought by the clothes of third persons afflicted with diseases of greater or lesser severity.

These disadvantages are overcome by a novel process which has been found by the Applicant. This process makes it possible easily to clean clothes at home, in a minimum length of time, without leaving a residue and without leaving a ring.

The invention thus relates to a process for cleaning clothes at home with the aid of solvent, which comprises the following three successive operations:

A. treating the article of clothing with a liquid cleaning agent comprising at least one organic solvent, B. laying the article of clothing flat on an absorbent sheet, and C. laying the article of clothing + absorbent sheet flat on the interior circular surface of the drum of a washing machine in order to spin it.

The organic solvent or solvents present in the cleaning agent are chosen from the group comprising the organic liquids known for their stain-removing power.

The cleaning agent used in operation A of the process preferably comprises an alcoholic solvent, a ketonic solvent, an ether, a chlorinated solvent, a hydrocarbon or a mixture of two or more of the latter.

The alcoholic solvent, used by itself or mixed with another solvent or other solvents, is preferably chosen from the group comprising alkanols possessing one to four carbon atoms, such as methanol, ethanol, propanol, isopropanol, butanol, isobutanol, sec.-butanol, tert.-butanol and mixtures of these alkanols; the preferred alcoholic solvent is chosen from the group comprising ethanol, propanol and isopropanol; it can also be benzyl alcohol.

The ketonic solvent, used by itself or mixed with another solvent or other solvents, is preferably chosen from the group comprising alkanones having three to six carbon atoms, such as acetone, butanone, pentan-2-one, pentan-3-one, 2-methylbutan-3-one, hexan-3-one, 3-methylpentan-2-one, 4-methylpentan-2-one, 2-methylpentan-3-one and mixtures of these ketones; the ketonic solvent can also comprise cyclohexanone; the preferred ketonic solvent is chosen from the group comprising acetone and butanone.

The ether, used by itself or mixed with another solvent or other solvents, is preferably chosen from the group comprising oxaalkanes and their hydroxy-substituted derivatives, gamma-dioxaalkanes and their hydroxy-substituted derivatives, bis-gamma-trioxaalkanes having a maximum of ten carbon atoms, and mixtures of these compounds.

Examples of oxaalkanes are diethyl ether, dipropyl ether, diisopropyl ether, butyl ether and isobutyl ether. Examples of hydroxy-substituted oxaalkanes and 2-methoxyethanol, 2-ethoxyethanol, 2-isopropoxyethanol, 2-methoxypropanol, 2-ethoxypropanol and 2-isopropoxypropanol.

Examples of gamma-dioxaalkanes are the dimethyl, diethyl, dipropyl and diisopropyl ethers of ethylene glycol, of propylene glycol and of butylene glycol.

Examples of hydroxy-substituted gamma-dioxaalkanes are the monomethyl, monoethyl, monopropyl and monoisopropyl ethers of diethylene glycol and of dipropylene glycol.

Examples of bis-gamma-trioxaalkanes are the dimethyl, diethyl, dipropyl and diisopropyl ethers of diethylene glycol and the dimethyl and diethyl ethers of dipropylene glycol.

Preferably, the ethers have an evaporation index of less than one hundred times that of ethyl ether, the said index being proportional to the time required for total evaporation of the solvent deposited on a filter paper.

The chlorinated solvent, used by itself or mixed with another solvent or other solvents, is preferably chosen from the group comprising the di- to tetrachlorinated derivatives of methane, the di- to pentachlorinated derivatives of ethane and of ethylene, the mono- to trichlorinated derivatives of cyclohexane, and monochlorobenzene. Examples of solvents of this type are methylene chloride, 1,1-dichloroethane, 1,2-dichloroethane, 1,1-dichloroethylene, 1,2-dichloroethylene, 1,1,1-trichloroethane, 1,1,2-trichloroethane, trichloroethylene, 1,1,2,2-tetrachloroethane, tetrachloroethylene, pentachloroethane, monochlorocyclohexane, 1,4-dichlorocyclohexane, monochlorobenzene and mixtures of these compounds.

The hydrocarbon, used by itself or mixed with another solvent or other solvents, is preferably chosen from the group comprising saturated cyclic, aliphatic or alicyclic hydrocarbons, aromatic or alkylaromatic hydrocarbons, terpene hydrocarbons having 10 carbon atoms, and mixtures of these hydrocarbons.

The aromatic and alkylaromatic compounds, used by themselves or mixed with the other hydrocarbons, are chosen, for example, from the group comprising the following: toluene, ethylbenzene, ortho-xylene, meta-xylene, paraxylene, isopropylbenzene, 1,3,5-trimethylbenzene, cymene, pseudo-cumene, 1,4-diisopropylbenzene, tetralin, 1-methyltetralin, 2-methyltetralin and mixtures thereof.

The saturated hydrocarbons, used by themselves or mixed with the other hydrocarbons, are chosen, for example, from the group comprising the following: 2-methylheptane, octane, ethylcyclohexane, nonane, isopropylcyclohexane, decane, undecane, dodecane, decalin, 1,2-dimethylcyclohexane, 1,3-dimethylcyclohexane, 1,4-dimethylcyclohexane, 2-methyloctane, 2-methylnonane and mixtures thereof.

The commercially available mixtures of aromatic hydrocarbons and their mixtures with saturated hydrocarbons are also suitable. Examples of such mixtures are the following, in which the percentages of aromatic hydrocarbons are indicated in brackets: Panasol RX-5 (70%), RX-21 (99%), RX-22 (94%) and RX-34 (100%), Amsco LEP Solvent (18.5%), Amsco mineral spirit (17%), Amsco 140 Solvent (17%), Amsco 460 Solvent (18%), Laktane Esso (21.5%), Varsol 1 Esso (18%), Varsol 2 Esso (31.5%), Varsol 3 Esso (15%), Solvesso 100 (99%), Solvesso 150 (97%), Tolu-Sol 19 Shell (25%), Tolu-Sol 25 Shell (25%), Tolu-Sol 28 Shell (28%), Tolu-Sol 40 Shell (39%), Tolu-Sol 45 Shell (45%), Cyclo-Sol 43 Shell (99%), TS-28 R Shell (73%), TS-28 Shell (75%), Cyclo-Sol 53 Shell (99.5%), Cyclo-Sol 63 Shell (99.5%), Mineral Spirits 105 Shell (28%), Mineral Spirits 110 Shell (27%), Nona-Sol 120 Shell (20%), white spirit Shell (17%), White Spirit BP (18%), Dilutine M 5 Shell (<5%), Dilutine 21 Shell (17%), Tetrasol G Shell (<5%), Sangajol B Shell (17%), Solnap BP (3%), Supersol BP (97%), Petrole normal BP (15%), Exsol D. 45/100 Esso (1.2%), Exsol D. 60/95 Esso (1.2%), Exsol D. 70/100 Esso (1.2%), Exsol D. 100/130 Esso (4%), Exsol D. 100/160 Esso (4%), Exsol D. 145/195 Esso (5%), Varsol 145/195 Esso (17%), Essence speciale E Esso (9%) and Essence speciale F Esso (12.5%).

The terpene hydrocarbons, used by themselves or in a mixture with the other hydrocarbons, are chosen, for example, from the group comprising the following: pinene, limonene, dipentene, terpinene, terpinolene, menthene, myrcene, sabinene, oreimene, thellandrene and mixtures thereof.

If desired, but preferably, the cleaning agent can also contain an amount of water of up to 60 percent by weight of the cleaning agent. In this case, the water is advantageously, but not obligatorily, accompanied by a surface-active agent. If desired, the latter can also be present in the absence of water.

The surface-active agents which can be used according to the invention can be chosen from the group comprising all the known anionic, cationic, amphoteric or non-ionic surface-active agents. Representative surface-active agents are described in "*McCutcheon's Detergents and Emulsifiers* 1969 Annual", in which these compounds are indexed according to their chemical formula and their tradename. Other suitable surface-active agents are described in *Surface Active Agents and Detergents,* Volume II, by Schwartz, Perry and Berch (Interscience Publishers, 1958).

Examples of suitable anionic surface-active agents are soaps and also synthetic sulfated and sulfonated surface-active agents, in particular the anionic surface-active agents having about 8 to 26, and preferably about 10 to 22, carbon atoms per molecule. The soaps are generally the water-soluble soaps of long-chain fatty acids each having from 10 to 18 carbon atoms, and mixtures thereof.

The sulfated and sulfonated surface-active agents are also known in the art and can be prepared from suitable organic materials capable of being sulfonated (which can undergo "true" sulfonation and/or sulfation). Amongst the wide variety of suitable sulfates and sulfonates, it is preferable to use the aliphatic sulfates and sulfonates having about 8 to 22 carbon atoms in the alkyl group, and preferably having 12 to 18 carbon atoms.

The detergent alkylaromatic sulfonates in question can possess a mononuclear or polynuclear structure.

More particularly, the aromatic nucleus can originate from benzene, toluene, xylene, phenol, cresols, phenol ethers, naphthalene or derivatives of phenanthrene. It has also been discovered that the alkyl group can vary in a similar manner. Thus, for example, the alkyl groups can have a linear or branched chain (the linear chains being highly preferable) and can be, for example, dodecyl, tridecyl, pentadecyl, octyl, nonyl, decyl or undecyl radicals, mixed alkyls derived from fatty products, olefins consisting of cracked paraffin wax, or also polymers of lower monoolefins. Although the number of sulfonic acid groups present on the nucleus can vary, only one of these groups is usually present, in order to preserve the best possible balance between the hydrophilic and hydrophobic parts of the molecule and to obtain efficient surface activity.

Other particular examples of suitable surface-active alkylaromatic sulfonates are the linear alkylbenzenesulfonates in which the alkyl group contains from 10 to 18 carbon atoms, for example from about 10 to 15 carbon atoms on average, particular examples of which are sodium dodecylbenzenesulfonate, sodium tridecylbenzenesulfonate and the sodium alkyl(higher)-benzenesulfonates in which the alkyl has from 10 to 15 carbon atoms and contains an average of 12.5 carbon atoms per molecule.

Other suitable agents are the sulfated or sulfonated surface-active aliphatic compounds preferably having 12 to 22 carbon atoms. The following correspond to this definition: sulfuric acid esters of polyalcohols incompletely esterified by long-chain fatty acids, for example the monosulfate of coconut oil monoglyceride and the monosulfate of tallow glyceride, pure or mixed long-chain alkyl sulfates, for example lauryl sulfate and cetyl sulfate, hydroxysulfonated long-chain fatty acid esters, such as long-chain fatty acid esters of low molecular weight alkylolsulfonic acids, for example the fatty acid esters of isethionic acid, the sulfates of fatty acid ethanolamides of aminoalkylsulfonic acids (for example the laurylamide of taurine), and olefin- and paraffinsulfonates. More particularly, it is preferable to use the sulfated aliphatic compounds containing at least about 8 carbon atoms, in particular those containing about 12 to 18 or 22 carbon atoms per molecule. If the presence of contained phosphorus is permitted, it is also possible to use the corresponding organic phosphates and phosphonates, in addition to or instead of the surface-active aliphatic and aromatic sulfates and sulfonates.

Cationic surface-active agents which can be used are long-chain quaternary alkylammonium compounds, for example quaternary cetylammonium salts. This group includes: cetyltrimethylammonium chloride and cetylpyridinium chloride. Diethyleneaminoethyl-oleylamide is another compound which can be used.

The non-ionic surface-active agents comprise: polyoxyethylene ethers of hydroxy-substituted alkylaromatic compounds (for example polyoxyethyleneated alkylphenols), the polyoxyethylene ethers of hydrophobic propylene oxide polymers, and also alkyl(higher)-amine oxides, such as lauryldimethylamine oxide. It is also possible, according to the invention, to use amphoteric agents, examples of which are: salts of alkyl(higher)-beta-aminopropionic acids, for example the sodium salt of N-laurylbeta-alanine, betaines substituted by higher alkyl groups, for example lauryldimethylammonium-acetic acid, and also compounds of the imidazoline type, an example of which is the disodium salt of 1-(2-hydroxyethyl)-1-(carboxymethyl)-2-(hendecyl)-4,5-dihydroimidazolinium hydroxide.

The anionic and cationic surface-active agents are commonly used in the form of their water-soluble salts. As regards the synthetic anionic compounds, the alkali metal salts (for example the sodium and potassium salts) are preferable, although it is possible, if desired, to use other salts, for example ammonium salts, salts of alkyl-(lower)-amines (i.e. of mono- and tri-alkylamines having 1 to 4 carbon atoms in the alkyl group, for example of methylamine, diisopropylamine and tributylamine), salts of lower alkanolamines (for example of ethanolamine, diethanolamine, triethanolamine and isopropanolamine) and also alkaline earth metal salts and salts of similar metals, for example of calcium and magnesium. As regards the cationic surface-active agents, the anions chloride, sulfate, acetate and the like can be present.

In the process according to the invention, it is preferred to use alkyldimethylamine oxides and acylaminoalkyl-dimethylamine oxides, such as dodecyldimethylamine oxide and 3-lauroylamidopropyl-dimethylamine oxide, by themselves or mixed with an anionic surface-active agent, such as a sodium alkyl-sulfate or alkyl-ether-sulfate, and/or a non-ionic surface-active agent, such as a polyoxyethyleneated alkylphenol, for example oxyethyleneated octyl- or nonyl-phenol preferably containing 8 to 10 mols of ethylene oxide.

If it is used, the surface-active agent is preferably present in the cleaning agent in a proportion of between 0.1 and 25 percent by weight.

If the cleaning agent contains water, the composition thus formed can be homogeneous without agitation being required, or, in contrast, it can require agitation in order to mix the constituents and to obtain a suspension, the stability of which is ensured for a period of time which is at least as long as the treatment.

The water which is present in the cleaning agent, if desired, is a soft water of any origin (river, spring or rain); it is preferable to use a water of low hardness or even more preferable to use a demineralised water. The amount of water, if it is present in the cleaning agent, is preferably between 5 and 60 percent by weight.

If desired, the cleaning agent can also contain a chlorofluorinated compound which has one or two carbon atoms and which is chosen from the group comprising the compounds which are liquid at ambient temperature, such as trichlorofluoromethane and trichlorotrifluoroethane.

If desired, the cleaning agent can also contain an anti-foam agent, a perfume, an antistatic agent, an aerosol propellant and/or a bactericide.

If the cleaning agent contains several organic solvents, one of them is preferably chosen from the group comprising alcoholic solvents; even more preferably, the said solvent consists of isopropanol.

The alcoholic solvent, if it is not the only solvent in the cleaning agent, is preferably present in the latter in a proportion of 10 to 90 percent by weight for an anhydrous composition and 3 to 60 percent by weight for an aqueous composition.

The ether, if it is not the only solvent in the cleaning agent, is preferably present in the latter in a proportion of 2 to 90 percent by weight for an anhydrous composition and 0.5 to 40 percent by weight for an aqueous composition.

The ketonic solvent, if it is not the only solvent in the cleaning agent, is preferably present in the latter in a proportion of between 0.2 and 10 percent by weight.

The chlorinated solvent, if it is not the only solvent in the cleaning agent, is preferably present in the latter in a proportion of between 3 and 45 percent by weight.

The hydrocarbon, if it is not the only solvent in the cleaning agent, is preferably present in the latter in a proportion of between 3 and 60 percent by weight.

If it is present in the cleaning agent, the chlorofluorinated solvent is preferably incorporated in a proportion of between 5 and 50 percent by weight.

The cleaning agent used in the operation can be applied in any manner, such as by soaking or spraying; however, spraying is preferred by far, because it is easier to carry out and more economical. For this purpose, a reservoir containing the cleaning agent is used, such as a supple bottle, which produces a spray simply by pressing, or a container fitted with a direct-delivery pump or a pre-pressurised pump. It is also possible to use an aerosol container, in which case a propellant chosen from the group comprising the propellants which are known to those skilled in the art, for example propane, butane, dichlorodifluoromethane, nitrous oxide and carbon dioxide, is added to the cleaning agent; in this case, for example, 20 to 100 parts of propane, butane or dichlorodifluoromethane, or 3 to 10 parts of nitrous oxide or carbon dioxide, per 100 parts by weight of cleaning agent, are introduced.

If the article of clothing to be treated has localised stains, it is possible to spray a larger amount of the cleaning agent onto these stains and to rub them with a suitable material, such as a rag or a piece of felt. For this purpose, the said material can be permanently installed on the reservoir containing the cleaning agent, which makes it possible to spray and rub simultaneously with the same hand.

According to an advantageous variant of the process, operation A is carried out in two successive stages each using a specialised cleaning agent and consisting of: A1. treatment of the localised stains with a stain-removing agent, and A2. generalised treatment of the article of clothing with a rinsing agent.

The stain-removing and rinsing agents conform to the description, given above, of the cleaning agent; they can be similar to one another, but it is generally preferable to use a more highly active product for the stain-removing agent than for the rinsing agent.

A particularly advantageous stain-removing agent can be, for example, a composition containing several solvents, water and a surface-active agent.

A stain-removing composition will comprise, for example:

| | | |
|---|---|---|
| surface-active agent: | — | 2 to 20% |
| water: | — | 20 to 60% |
| alcoholic solvent: | 10 to 85% | 5 to 30% |
| ether: | 15 to 90% | 5 to 40% |

Even more preferably, the said stain-removing composition will also comprise one or more of the following constituents:

| | |
|---|---|
| ketonic solvent: | 2 to 20% |
| chlorinated solvent: | 5 to 25% |
| hydrocarbon: | 20 to 30% |

A particularly advantageous rinsing agent can be, for example, a composition containing several solvents, water and a surface-active agent, in different proportions from those of the stain-removing agent.

A rinsing composition will comprise, for example:

| | | |
|---|---|---|
| surface-active agent: | — | 0.1 to 6% |
| water: | — | 5 to 35% |
| alcoholic solvent: | 30 to 98% | 15 to 60% |
| ether: | 2 to 70% | 0.5 to 30% |

Even more preferably, the said rinsing composition will also comprise one or more of the following constituents:

| | |
|---|---|
| ketonic solvent: | 1 to 5% |
| chlorinated solvent: | 3 to 10% |
| hydrocarbon: | 4 to 20% |

The stain-removing agent is preferably contained in a reservoir fitted with a fibrous or porous material constituting a rubbing cloth, as stated above. This material advantageously consists of a felt of wool and/or cotton and/or solvent-resistant synthetic fibres.

According to an advantageous embodiment, the stain-removing agent is enclosed in a reservoir of elongate cylindrical shape, the opening of which is fitted with the porous material constituting the rubbing cloth; this material makes contact with the stain-removing agent via the internal part, and the stain-removing agent is thus brought by porosity up to the external end, which is intended to come into contact with the article of clothing.

The rinsing agent is preferably contained in a reservoir having a hand-operated, mechanical or propellant-operated spraying system.

In operation B of the process, the article of clothing is laid flat on an absorbent sheet. Of course, according to a variant of the process, it is possible for the article of clothing to have been spread over the absorbent sheet prior to treatment A.

The absorbent sheet consists of any known porous or fibrous, flexible substance. Examples of absorbent sheets are, in particular, paper, preferably slightly sized or unsized, cotton fabrics, nonwovens made of vegetable fibres, felts and cellulose wadding, in one or more layers. An absorbent sheet can also consist of a layer of absorbent powdery substance between two layers of fibrous substance or between a layer of fibrous substance and a layer of impermeable substance, such as a polyethylene sheet. An absorbent powdery substance can be a dry clay, a kaolin, a montmorillonite, a natural or synthetic silica or a ground vegetable fibre.

The thickness of the absorbent sheet depends on the absorption capacity of the latter; in practice, the thickness used will correspond to a density of between 15 and 200 grams per square meter and preferably between 30 and 100 grams per square meter.

The dimensions of the absorbent sheet depend, on the one hand, on those of the drums of the washing machines, and, on the other hand, on those of the article or articles of clothing treated. In practice, the strip used will be 5 to 15 cm wide for a tie or a scarf and up to 150 cm wide for several ties or scarves.

To treat a pair of trousers, a jacket or a gabardine raincoat, the strip used will have the maximum width and length permitted by the washing machine. Preferably, the absorbent sheet will have a length of between 30 and 150 cm and a width of between 5 and 40 cm.

For clothes of intermediate sizes, the dimensions of the absorbent sheet used will also be intermediate and suitable for the size of the article or articles of clothing treated.

Of course, it is possible advantageously to place small pieces of absorbent sheet at the points where the clothes are folded, such as the collars, cuffs, loops or lapels.

Of course, if desired, and depending on the state of soiling of the clothes previously treated, the absorbent sheet can be re-used one or more times, for example after drying.

According to an advantageous variant, the absorbent sheet can consist of several layers, the one which has been in contact with the article of clothing being removed before the next treatment. For the purpose of imparting particular properties thereto, the absorbent sheet can also possess a special structure, such as a corrugated, pleated, goffered or calendered structure.

To enable them to be held close against the internal wall of the drum of the washing machine, the absorbent sheet and the article or articles of clothing treated can be kept together by means of a system of clips and/or slides, it being possible for the latter advantageously to occupy the whole width of the absorbent sheet. It is also possible to use a rigid plastic or metal strap onto which the absorbent sheet+article of clothing is fixed.

On the face which is opposite the face in contact with the article of clothing, the absorbent sheet can also be covered with an impermeable sheet of greater or lesser rigidity, which is chosen, for example, from the group comprising sheets of polyethylene, polypropylene, polyamide and a multi-layer complex.

According to an advantageous variant, the impermeable sheet is obtained by hot-coating onto the absorbent sheet and is integral with the latter.

According to another variant, the width of the impermeable sheet exceeds that of the absorbent sheet on one or both of the sides, so that it can be folded over onto that face of the article of clothing which is opposite the face in contact with the absorbent sheet.

According to another variant, the impermeable sheet which overlaps the absorbent sheet possesses a fastening system which makes it possible to keep it closed on top of the article or articles of clothing; a system of this type can consist of press-studs, a zip, a "Velcro" strip, hooks or the like. In the limiting case, a system of this type can make it possible to achieve a leaktight envelope around the article or articles of clothing, so as to permit spinning even in the presence of water in the washing machine.

According to another variant, the impermeable sheet which overlaps the absorbent sheet forms a bag which encloses the latter and the article or articles of clothing.

According to another variant, the impermeable sheet in the form of a bag possesses gussets which make it possible to increase its capacity.

The purpose of the absorbent sheet is to collect the cleaning agent after digestion of the dirt on the article or articles of clothing.

Spinning is used in order to enable the cleaning agent to migrate as completely as possible into the absorbent layer. This operation forms the subject of stage C, in which the article of clothing+absorbent sheet, with the impermeable sheet, if desired, is laid flat on the interior circular surface of the drum of a washing machine, the article of clothing being placed facing the interior of the drum and the absorbent sheet being placed facing the perforated wall of the drum. It then suffices to start up the drum after having cut off the water intake.

If the washing machine possesses a program, the programmer is switched to the spinning position. One spinning cycle may suffice, but it is generally preferable to use two cycles.

The article of clothing + absorbent sheet can be held on the wall of the drum either by the inherent rigidity of the absorbent sheet and/or of the impermeable sheet, if the latter is present, or by means of a system of clips, fasteners, slides or ribs or by means of any other appropriate system.

When the spinning has ended, the assembly is removed from the drum and the article of clothing is separated from the absorbent sheet. The article of clothing can be used as it is, but it is generally preferable to allow it to finish drying. Of course, if the washing machine possesses a drying device, the latter can be used to complete the work. It is preferable, in this case, for the article of clothing not to be completely covered with an impermeable sheet.

The advantage of the process according to the invention is illustrated by the following examples and experiments, which cannot be considered to imply a limitation. Unless stated otherwise, the parts and percentages are by weight, based on the total weight of the cleaning agent in question.

| | Examples 1 to 17 Anhydrous cleaning agents | | | | | | | | | | | | | | | | |
|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 |
| Isopropanol | 50 | 78 | 65 | — | 40 | 10 | — | — | 24 | 26 | 2 | 28 | 50 | 80 | 44 | — | — |
| Ethanol | — | — | — | — | — | — | 10 | — | — | — | — | 7 | — | — | — | — | — |
| n-Propanol | — | — | — | — | — | — | — | — | 15 | — | — | — | — | — | — | — | — |
| Isobutanol | — | — | — | — | — | — | 18 | — | — | — | — | — | 17 | — | — | — | — |
| 2-Ethoxyethanol | 50 | — | — | — | — | — | — | — | 25 | — | — | 20 | 7 | — | — | 1 | 1 |
| 2-Isopropoxyethanol | — | — | — | — | — | — | — | 6 | — | — | — | 7 | — | 5 | 44 | — | — |
| Diisopropyl ether | — | — | — | — | — | — | 4 | — | — | — | — | — | — | — | — | — | — |
| 3,6-Dioxaoctane | — | — | — | — | — | — | — | — | — | 4 | — | — | — | — | — | — | — |
| 5,8-Dioxadodecane | — | — | — | — | — | — | — | — | 7 | — | — | — | — | — | — | — | — |
| 3,6,9-Trioxa-undecane | — | — | — | — | — | — | — | — | — | — | — | 8 | — | — | — | — | — |
| Diglyme | — | — | — | — | — | — | — | 6 | — | — | — | — | — | — | — | — | — |
| Triglyme | — | — | — | — | — | — | — | — | 7 | — | — | — | — | 5 | — | — | — |
| Acetone | — | 22 | — | — | — | — | — | — | — | — | — | 10 | — | — | — | 0.7 | 0.5 |
| Butan-2-one | — | — | — | — | — | — | — | — | — | 4 | — | — | — | 10 | — | — | — |
| 4-Methylpentan-2-one | — | — | — | — | — | — | — | — | — | — | 2 | — | — | — | — | — | — |
| Cyclohexanone | — | — | — | — | — | — | — | — | — | — | — | — | 1 | — | 12 | — | — |
| Methylene chloride | — | — | — | — | — | — | 32 | 30 | 22 | — | 30 | 20 | — | — | — | 10 | 10 |
| 1,1,1-Trichloro-ethane | — | — | — | — | — | — | — | 14 | — | — | — | — | — | — | — | — | — |
| Tetrachloroethylene | — | — | — | — | — | — | — | — | — | — | 18 | — | — | — | — | — | — |
| n-Decane | — | — | — | — | — | — | — | 40 | — | — | 48 | — | — | — | — | — | — |
| Hydrocarbon cut (F) | — | — | — | 40 | — | 50 | 50 | — | — | — | — | — | — | — | — | 50 | 58.4 |
| white Spirit, 17% of aromatics | — | — | 35 | — | — | — | — | — | — | 66 | — | — | — | — | — | — | — |
| Dipentene | — | — | — | — | — | 8 | — | — | — | — | — | — | — | — | — | — | — |
| Limonene | — | — | — | — | — | — | 18 | — | — | — | — | — | — | — | — | 8 | — |
| Toluene | — | — | — | — | — | — | — | 4 | — | — | — | — | — | — | — | — | — |
| Trichlorotrifluoro-ethane | — | — | — | 60 | 40 | — | — | — | — | — | — | — | 35 | — | — | — | 30 |
| Trichlorofluoro-methane | — | — | — | — | 20 | — | — | — | — | — | — | — | — | — | — | 30 | — |
| Surface-active agent (b') | — | — | — | — | — | — | — | — | — | — | — | — | — | — | — | 0.3 | 0.1 |

(b') Polyoxyethyleneated nonylphenol containing 9.8 mols of ethylene oxide, "EMULGIN 286" ®.
(F) cut of synthetic lower isoalkanes, "ISOPAR G" ®.

| | Example 18 to 34 Cleaning agents containing water | | | | | | | | | | | | | | | | |
|---|---|---|---|---|---|---|---|---|---|---|---|---|---|---|---|---|---|
| | 18 | 19 | 20 | 21 | 22 | 23 | 24 | 25 | 26 | 27 | 28 | 29 | 30 | 31 | 32 | 33 | 34 |
| Surface-active agent (a) | 1.2 | 0.5 | 8 | 8 | — | — | — | — | .6 | — | — | 5.5 | — | — | — | 7.5 | 1.2 |
| Surface-active agent (b) | — | — | — | — | 0.5 | — | — | — | — | 1 | — | — | 0.5 | — | 8 | — | — |
| Surface-active agent (c) | — | — | — | — | — | 0.5 | — | 0.6 | — | — | — | — | — | — | — | — | — |
| Surface-active agent (d) | — | — | — | — | — | — | 1 | — | — | — | 8 | — | — | — | — | — | — |
| River water | — | — | 69 | 56 | — | — | — | — | 44 | — | — | 60.5 | — | — | 51 | — | — |
| Demineralised water | — | 78.5 | — | — | — | 78.5 | 55.5 | — | — | 49 | 41 | — | 33.5 | — | — | 38.5 | 53.8 |
| Distilled water | 56.8 | — | — | — | — | — | — | 68.4 | — | — | — | — | — | 79 | — | — | — |
| Isopropanol | 12 | 10 | — | 10 | 20 | 17 | — | 1 | — | 1 | 18 | 8 | 38 | 17 | 12 | 17 | 12 |
| Ethanol | — | 7 | 10 | 8 | — | — | — | — | — | — | — | 4 | — | — | 6 | — | — |
| n-Propanol | — | — | 8 | — | — | — | 12 | — | — | — | — | — | — | — | — | — | — |
| 2-Ethoxyethanol | — | — | — | 18 | — | 2 | — | — | 3 | — | — | 8 | 4.5 | 2 | 8 | 17 | 1.5 |
| Diisopropyl ether | — | — | — | — | — | — | 1.5 | — | — | — | — | 4 | — | — | — | — | — |

-continued

| | Example 18 to 34 Cleaning agents containing water | | | | | | | | | | | | | | | | |
|---|---|---|---|---|---|---|---|---|---|---|---|---|---|---|---|---|---|
| | 18 | 19 | 20 | 21 | 22 | 23 | 24 | 25 | 26 | 27 | 28 | 29 | 30 | 31 | 32 | 33 | 34 |
| 5,8-Dioxadodecane | — | — | — | — | — | — | — | — | 3 | — | — | — | — | — | 10 | — | — |
| Diglyme | — | — | — | — | — | — | — | — | — | — | 18 | — | — | — | — | — | — |
| Acetone | — | — | 5 | — | — | 2 | — | — | — | — | 5 | 3.5 | 0.5 | 2 | — | — | 1.5 |
| Butan-2-one | — | — | — | — | — | — | — | — | — | 1 | — | — | — | — | — | — | — |
| Cyclohexanone | — | — | — | — | — | — | — | — | — | — | — | — | — | — | 5 | 5 | — |
| Methylene chloride | — | — | — | — | — | — | — | 10 | 10 | 24 | 10 | 6.5 | — | — | — | — | — |
| 1,1,1-Trichloro-ethane | — | — | — | — | — | — | — | — | 12 | — | — | — | — | — | — | — | — |
| Tetrachloroethylene | — | — | — | — | — | — | — | — | — | — | — | — | — | — | — | 15 | — |
| n-Dodecane | — | — | — | — | — | — | 24 | — | — | — | — | — | — | — | — | — | — |
| n-Heptane | — | — | — | — | — | — | — | — | 22 | — | — | — | — | — | — | — | — |
| Hydrocarbon cut (F) | 30 | — | — | — | — | — | — | — | — | — | — | — | — | — | — | — | 30 |
| White Spirit, 5% of aromatics | — | — | — | — | — | — | — | 20 | — | 24 | — | — | — | — | — | — | — |
| Limonene | — | — | — | — | — | — | 6 | — | — | — | — | — | — | — | — | — | — |
| Toluene | — | 4 | — | — | — | — | — | — | — | — | — | — | — | — | — | — | — |
| Trichlorotrifluoro-ethane | — | — | — | — | 30 | — | — | — | — | — | — | — | 23 | — | — | — | — |

(a) N-acyl(C-7/17)-amidopropyl-N'-dimethylamine oxide.
(b) Polyoxyethyleneated octylphenol containing 12 mols of ethylene oxide.
(c) Polyoxyethyleneated nonylphenol containing 8 mols of ethylene oxide.
(d) Polyoxyethyleneated nonylphenol containing 10 mols of ethylene oxide.
(F) Cut of synthetic lower isoalkanes.

EXPERIMENT 1

A combination comprising a cleaning agent and an absorbent sheet, made up as stated below (values in percentages by weight), was prepared: 1. Cleaning agent

| | |
|---|---|
| Surface-active agent (a) | 0.5% |
| Demineralised water | 36.0% |
| Isopropanol | 33.5% |
| Acetone | 1.0% |
| 2-Ethoxyethanol | 8.0% |
| Methylene chloride | 4.5% |
| Monochlorobenzene | 0.5% |
| Trichlorotrifluoroethane | 16.0% |

(a) N-acyl(C-7/17)-amidopropyl-N'-dimethylamine oxide.

The cleaning agent was placed in a bottle fitted with a small hand-operated pump dispensing the composition in the form of a spray; a patch of felt (so-called piano-hammer quality) having a diameter of 20 mm and a thickness of 8 mm, to be used as a rubbing cloth, was stuck to the pump, on the part opposite its orifice. 2. Absorbent sheet The absorbent sheet consisted of a single layer of a light blue-coloured nonwoven weighing 70 g/m$^2$ and having a width of 25 cm and a length of one meter.

The absorbent sheet was covered on one face with an impermeable sheet consisting of a polyethylene sheet weighing 22 g/m$^2$ and obtained by hot-coating onto the absorbent sheet; a polyethylene sheet having a thickness of 0.05 mm and a width of 20 cm was welded onto the edge of this impermeable sheet, over the entire length.

The combination made up in this way was used to clean stains produced on a 25×35 cm piece of pure new wool fabric, the said stains having a size of about 1 cm$^2$ and originating from the following products: sweetened coffee, dirty grease, black shoe-polish, mulberry jam, black felt-pen ink, olive oil, ketchup, mustard, syrup of pomegranate, vinegar and red wine. These stains were left to age for several days and the process was then applied as follows:

spraying onto the stains and using the rubbing cloth (the fabric being placed on the absorbent sheet in order to facilitate the removal of the stains);

general spraying onto the whole of the fabric;

laying the fabric flat on the absorbent sheet (side not coated with polyethylene);

covering the fabric with the 0.05 mm polyethylene sheet;

laying the whole against the circular surface of the drum of a washing machine and fixing it by means of rigid polyethylene slides;

spinning for 10 minutes; and removing the fabric and drying it for 30 minutes in the atmosphere.

It was then possible to observe that all the stains had disappeared, and a comparison of the fabric treated in this way with an identical fabric which was unstained and untreated did not make it possible to detect any difference.

In parallel, stains were removed from identical pieces of fabric stained in the same manner, using ten different commercially available products for removing stains at home and ten stain-removing products for industrial use. The operation was completed by soaking in perchloroethylene (1,1,2,2-tetrachloroethylene), followed by drying in the atmosphere.

In all cases, it was observed that the quality of the cleaning achieved was inferior to that obtained by the process according to the invention. To obtain a suitable result other than by the method according to the invention, it was necessary to resort to the use of a specific industrial stain remover for each of the stains.

EXPERIMENT 2

The procedure of Experiment 1 was followed using a "Tergal" ® wool/polyester fabric, and the same results were obtained.

EXPERIMENT 3

The procedure of Experiment 1 was followed using a natural silk fabric, and the same results were obtained.

EXPERIMENT 4

The procedure of Experiment 1 was followed using a viscose acetate fabric, and the same results were obtained.

EXPERIMENT 5

The procedure of Experiment 1 was followed using a cotton fabric, and the same results were obtained.

EXPERIMENT 6

The procedure of Experiment 1 was followed using a "Dacron"® cotton/polyester fabric, and the same results were obtained.

EXPERIMENT 7

The procedure of Experiment 1 was followed using the following compositions 7-A to 7-F in succession:

| | 7-A | 7-B | 7-C | 7-D | 7-E | 7-F |
|---|---|---|---|---|---|---|
| Surface-active agent (a) | — | 0.5 | 0.5 | 0.5 | 1.0 | 5.5 |
| Surface-active agent (a') | 0.5 | — | — | — | — | — |
| Surface-active agent (a'') | — | — | — | 0.1 | — | — |
| Demineralised water | 36.0 | 33.0 | — | — | 33.0 | — |
| River water | — | — | 33.0 | 36.0 | — | 30.5 |
| Isopropanol | 33.5 | 25.0 | 26.0 | 33.4 | 30.0 | 20.0 |
| Ethanol | — | 5.5 | — | — | — | 4.5 |
| Isobutanol | — | — | 4.5 | — | — | 2.0 |
| Acetone | 1.0 | — | — | 1.0 | 1.0 | 3.0 |
| Cyclohexanone | — | — | 1.0 | — | — | — |
| 4-Methylpentan-2-one | — | 1.0 | — | — | — | — |
| 2-Ethoxyethanol | 8.0 | 14.0 | 14.0 | 8.0 | — | 12.0 |
| 2-Methoxyethanol | — | — | — | — | 14.0 | 0.5 |
| Methylene chloride | 4.5 | 5.0 | 21.0 | 18.0 | 5.0 | 3.5 |
| Monochlorobenzene | 0.5 | — | — | — | — | 3.5 |
| 1,1,2,2-Tetrachloro-ethylene | — | — | — | 3.0 | — | 1.5 |
| Trichlorofluoromethane | — | — | — | — | 16.0 | 3.5 |
| Trichlorotrifluoroethane | 16.0 | 16.0 | — | — | — | 10.0 |

(a) N-acyl(C-7/17)-amidopropyl-N'-dimethylamine oxide.
(a') N-oxide of the N,N-bis-(2-hydroxyethyl)-amide of coconut fatty acids, "EMCOL L 3625"®.
(a'') Fluorinated anionic surface-active agent, "FC 128"®.

In all cases, an identical result to that obtained in Experiment 1 was noted.

EXPERIMENT 8

The procedure of Experiment 1 was followed using, in succession, cleaning agents in two separate parts referred to as stain-removing compositions (8-D) and rinsing compositions (8-R), as follows:

| | Stain-removing compositions | | | | |
|---|---|---|---|---|---|
| | 8-D1 | 8-D2 | 8-D3 | 8-D4 | 8-D5 |
| Surface-active agent (a) | — | — | — | 8.0 | 12.0 |
| Surface-active agent (e) | 0.5 | 2.0 | — | — | — |
| Surface-active agent (b'') | — | — | 5.0 | — | — |
| River water | 4.5 | — | 72.5 | — | — |
| Demineralised water | — | 33.0 | — | 41.0 | 22.0 |
| Isopropanol | 27.2 | 20.0 | 2.5 | 10.0 | 18.0 |
| n-Propanol | — | 5.0 | — | — | — |
| Ethanol | — | — | — | 6.0 | — |
| Acetone | 4.5 | 5.0 | 2.5 | 3.5 | 5.0 |
| Butanone | — | — | — | 1.5 | — |
| 2-Ethoxyethanol | — | 25.0 | — | 2.0 | 18.0 |
| 3,6-Dioxadecanol | 13.6 | — | 5.0 | — | — |
| 2,6-Dimethyl-3-oxaheptanol | — | — | — | 18.0 | — |
| Methylene chloride | 22.6 | 5.0 | 2.5 | 5.0 | 20.0 |
| Monochlorobenzene | — | — | 10.0 | 5.0 | 5.0 |
| Hydrocarbon cut (F) | 9.0 | — | — | — | — |
| Limonene | — | 5.0 | — | — | — |

-continued

| | Stain-removing compositions | | | | |
|---|---|---|---|---|---|
| | 8-D1 | 8-D2 | 8-D3 | 8-D4 | 8-D5 |
| Trichlorotrifluoroethane | 18.1 | — | — | — | — |

(a) N-acyl(C-7/17)-amidopropyl-N'-dimethylamine oxide.
(b'') Mixture (1:1) of sodium alkylarylsulfonate and polyoxyethyleneated fatty alcohol, "TEXAPON P"®.
(e) Polyoxyethyleneated alkylphenol, "NEKANIL LN"®.
(F) Cut of synthetic lower isoalkanes, "ISOPAR G"®.

| | Rinsing compositions | | | | | |
|---|---|---|---|---|---|---|
| | 8-R1 | 8-R2 | 8-R3 | 8-R4 | 8-R5 | 8-R6 |
| Surface-active agent (a) | 5.5 | 0.5 | — | — | — | — |
| Surface-active agent (e) | — | — | — | — | — | 0.2 |
| Surface-active agent (b'') | — | — | — | 1.0 | 1.0 | 0.6 |
| Surface-active agent (d) | — | — | 1.0 | 1.0 | 1.0 | — |
| Surface-active agent (d') | — | — | 1.0 | — | — | — |
| River water | 30.5 | 33.0 | — | — | 15.0 | 15.5 |
| Demineralised water | — | — | 33.0 | 10.6 | — | — |
| Isopropanol | 26.5 | 30.5 | — | 21.0 | 15.0 | 35.7 |
| Benzyl alcohol | — | — | 25.0 | — | — | — |
| Acetone | 3.0 | 1.0 | 5.0 | 3.2 | 1.0 | 1.0 |
| Butanone | — | — | — | 2.0 | — | — |
| 2-Ethoxyethanol | 12.0 | 14.0 | 30.0 | — | — | 2.0 |
| 2-Methoxyethanol | 0.5 | — | — | — | — | 5.0 |
| 2-Butoxyethanol | — | — | — | 21.0 | 14.0 | — |
| 3,6-Dioxadecanol | — | — | — | — | 10.0 | — |
| Methylene chloride | 3.5 | 5.0 | 5.0 | 5.2 | 5.0 | 5.0 |
| 1,1,2,2-Tetrachloro-ethylene | 1.5 | — | — | — | — | — |
| Monochlorobenzene | 3.5 | — | — | — | — | — |
| Trichlorofluoromethane | 3.5 | — | — | — | — | — |
| Trichlorotrifluoro ethane | 10.0 | 16.0 | — | 35.0 | 38.0 | 35.0 |

(d) Polyoxyethyleneated nonylphenol containing 10 mols of ethylene oxide, "ARKOPAL N-100"®.
(d') Sodium dodecylbenzenesulfonate, "NANSA SS 50"®.

The stain-removing compositions were each placed in a cylindrical container having a diameter of 28 mm, the opening of which was fitted with a piece of felt making contact with the composition and serving as a rubbing cloth.

The rinsing compositions were placed in a container fitted with a small hand-operated pump making it possible to dispense the composition in the form of a spray.

The stains were initially treated spot by spot with a stain-removing composition, and the whole fabric was then treated by spraying with a rinsing composition. The treatment was completed as in Experiment 1. In all cases, the same results were obtained as in Experiment 1.

EXPERIMENT 9

A combination comprising a cleaning agent and an absorbent sheet, made up as stated below (values in percentages by weight), was prepared:

1. Cleaning agent

| | Stain-removing composition | Rinsing composition |
|---|---|---|
| Surface-active agent (a) | 8.0 | 0.24 |
| Demineralised water | 41.0 | 8.00 |
| Isopropanol | 18.0 | 34.56 |
| Acetone | 5.0 | 0.40 |
| 2-Ethoxyethanol | 18.0 | — |
| 2-Methoxyethanol | — | 0.80 |

-continued

| | Stain-removing composition | Rinsing composition |
|---|---|---|
| Methylene chloride | 5.0 | — |
| Monochlorobenzene | 5.0 | — |
| Perchloroethylene | — | 4.00 |
| Trichlorofluoromethane | — | 8.00 |
| Trichlorotrifluoroethane | — | 24.00 |
| Butane | — | 20.00 |

(a) N-acyl(C-7/17)-aminopropyl-N'-dimethylamine oxide.

The stain-removing composition was placed in a cylindrical container having a diameter of 28 mm, the opening of which was fitted with a piece of felt making contact with the composition and serving as a rubbing cloth.

The rinsing composition was placed in an aerosol container.

2. Absorbent sheet

The absorbent sheet consisted of 3 layers of bleached nonwoven weighing 20 g/m$^2$, and had a width of 25 cm and a length of 120 cm, enabling it to be cut as required.

The absorbent sheet comprised a goffered, white polyethylene impermeable sheet weighing 25 g/m$^2$ and having a width of 25 cm, welded to one side of the absorbent sheet, over the entire length.

The device also comprised a second, semi-rigid polyethylene impermeable sheet having a thickness of 0.3 mm.

This second impermeable sheet had a width of 70 cm and a length of 120 cm; it was folded over its entire length with a gusset on each side, so as to form an envelope having a width of 26 cm, intended for containing the absorbent sheet, the first impermeable sheet and the article of clothing; the envelope formed in this way could be closed by means of a "Velcro" system.

Combinations made up in this way were given to housewives with instructions for use. After 12 days, a survey was carried out in order to find out the use which had been made thereof and the results obtained, according to the judgement of the housewife, compared with the results generally obtained by her when entrusting her clothes to an industrial cleaner.

| Nature of the article of clothing | Amount | Results | | | |
|---|---|---|---|---|---|
| | | Good | Fairly good | Mediocre | Poor |
| Dress | 7 | 7 | — | — | — |
| Skirt | 11 | 11 | — | — | — |
| Pair of trousers | 28 | 25 | 2 | — | 1 |
| Jacket | 2 | 2 | — | — | — |
| Pullover | 12 | 9 | 1 | — | 2 |
| Blouse | 6 | 3 | 2 | — | 1 |
| Tie | 4 | 4 | — | — | — |
| Coat | 4 | 3 | 1 | — | — |
| Sweat shirt | 3 | 2 | — | — | 1 |
| Pyjamas | 2 | 2 | — | — | — |
| Raincoat | 5 | 3 | 1 | — | 1 |

-continued

| Nature of the article of clothing | Amount | Results | | | |
|---|---|---|---|---|---|
| | | Good | Fairly good | Mediocre | Poor |
| Total | 84 | 71 | 7 | 0 | 6 |

What is claimed is:

1. A process for cleaning textile materials with the aid of solvent, said process comprising (A) applying to said textile material a cleaning agent comprising at least one organic solvent;

(B) placing an absorbent sheet in contact with said textile material;

(C) covering the surface of said absorbent sheet not in contact with said textile material with an impermeable sheet;

(D) forming said impermeable sheet into a closed system encompassing the absorbent sheet and the textile material;

(E) spinning said closed system on the interior circular surface of a drum to enable the cleaning agent to migrate into the absorbent sheet; and (F) removing the textile material from the closed system.

2. A process according to claim 1, wherein treatment A uses a cleaning agent containing at least one solvent chosen from the group comprising alcoholic solvents, ketonic solvents, ethers, chlorinated solvents and hydrocarbons.

3. A process according to claim 1, wherein the cleaning agent contains water.

4. A process according to claim 1, wherein the cleaning agent contains a surface-active agent chosen from the group comprising anionic compounds, cationic compounds, amphoteric compounds and non-ionic compounds.

5. A process according to claim 1, wherein the cleaning agent contains a complementary solvent chosen from the group comprising the chlorofluorinated derivatives of methane or of ethane which are liquid at ambient temperature.

6. A process according to claim 1, wherein the cleaning agent is contained in a reservoir fitted with a device making it possible to dispense the agent in the form of a spray.

7. A process according to claim 1, wherein operation A is carried out in two successive stages each using a specialised cleaning agent and consisting of: A1. treatment of the localised stains on the article of clothing with a stain-removing agent, and A2. generalised treatment of the article of clothing with a rinsing agent.

8. A process according to claim 7, wherein the stain-removing agent is contained in a reservoir fitted at its opening with a fibrous or porous material which allows the cleaning agent to pass through when the reservoir is in the upturned position, and which is used as a rubbing cloth.

9. A process according to claim 1, wherein the absorbent sheet is chosen from the group comprising paper, cotton fabrics, nonwovens made of vegetable fibre, felts and cellulose wadding, it being possible for the absorbent sheet to consist of one or more layers and to contain an absorbent powdery material.

10. A process according to claim 1, wherein the article of clothing+absorbent sheet is held against the wall of the drum of the washing machine by means of a rigid device.

* * * * *